US005252775A

United States Patent [19]

Urano

[11] Patent Number: 5,252,775

[45] Date of Patent: Oct. 12, 1993

[54] AUTOMATICALLY UP-DATED APPARATUS FOR GENERATING MUSIC

[75] Inventor: Takayoshi Urano, Nagoya, Japan

[73] Assignee: Brother Kogyo Kabushiki Kaisha, Nagoya, Japan

[21] Appl. No.: 946,168

[22] Filed: Sep. 17, 1992

Related U.S. Application Data

[63] Continuation of Ser. No. 656,944, Feb. 19, 1991, abandoned.

[30] Foreign Application Priority Data

Feb. 17, 1990 [JP] Japan ..... 2-36600

[51] Int. Cl.[5] ..... G10H 7/00; G10K 11/18

[52] U.S. Cl. ..... 84/645; 358/86

[58] Field of Search ..... 84/645; 358/86; 81/600-603

[56] References Cited

U.S. PATENT DOCUMENTS

| | | | |
|---|---|---|---|
| Re. 31,004 | 8/1982 | Niimi | 84/645 X |
| 4,617,851 | 10/1986 | Sato | 84/DIG. 4 |
| 4,700,604 | 10/1987 | Morikawa et al. | 84/DIG. 12 |
| 4,711,148 | 12/1987 | Takeda et al. | 84/453 X |
| 4,734,764 | 3/1988 | Pocock et al. | 358/86 |
| 5,020,101 | 5/1991 | Brotz et al. | 84/671 |
| 5,025,701 | 6/1991 | Matsumoto | 84/615 |
| 5,041,963 | 8/1991 | Ebersol et al. | 364/200 |
| 5,046,004 | 9/1991 | Tsumura et al. | 364/419 |
| 5,048,014 | 9/1991 | Fischer | 370/85.5 |
| 5,119,188 | 6/1992 | McCalley et al. | 358/86 |
| 5,127,303 | 7/1992 | Tsumura et al. | 84/609 |

FOREIGN PATENT DOCUMENTS 60-83090 10/1983 Japan .

OTHER PUBLICATIONS

Teleharmonium of Thaddius Cahill from "Musical Applications of Microprocessors" by Hal Chamberlin by Hayden Book Co., 1985, pp. 35-36.

*Primary Examiner*—William M. Shoop, Jr.
*Assistant Examiner*—Brian Sircus
*Attorney, Agent, or Firm*—Oliff & Berridge

[57] ABSTRACT

The invention provides an improved music-generating system for efficiently supplying newly available music data to a plurality of music-generating terminal units. The music-generating system includes a host unit and a plurality of music-generating terminal units, and works basically as follows. The host unit transmits music data input through input circuitry to each of the plurality of music-generating terminal units via transmitting circuitry. The music-generating terminal unit receives music data transmitted from the host unit by receiving circuitry. Writing circuitry transmits and writes the music data onto memory. When selection signals are sent from an external device to the music-generating terminal unit, reproducing circuitry reads out specified music data from the memory according to the selection signals and reproduces music corresponding to the music data.

22 Claims, 4 Drawing Sheets

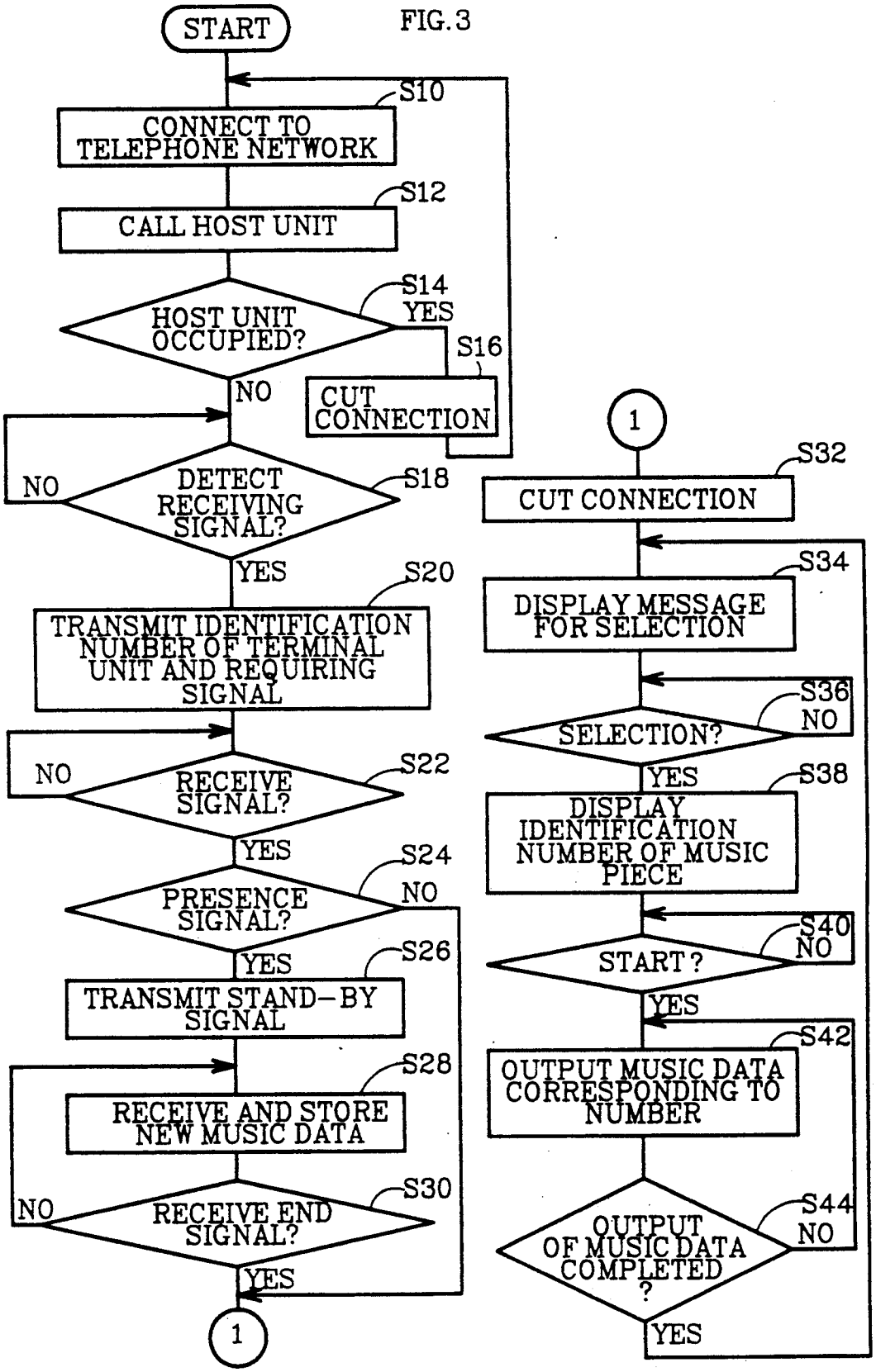
FIG. 3
START
S10
CONNECT TO TELEPHONE NETWORK
S12
CALL HOST UNIT
S14
HOST UNIT OCCUPIED?
YES
S16
CUT CONNECTION
NO
NO
DETECT RECEIVING SIGNAL?
S18
YES
S20
TRANSMIT IDENTIFICATION NUMBER OF TERMINAL UNIT AND REQUIRING SIGNAL
NO
RECEIVE SIGNAL?
S22
YES
S24
PRESENCE SIGNAL?
NO
YES
S26
TRANSMIT STAND-BY SIGNAL
S28
RECEIVE AND STORE NEW MUSIC DATA
S30
NO
RECEIVE END SIGNAL?
YES
1
1
S32
CUT CONNECTION
S34
DISPLAY MESSAGE FOR SELECTION
S36
SELECTION?
NO
YES
S38
DISPLAY IDENTIFICATION NUMBER OF MUSIC PIECE
S40
START?
NO
YES
S42
OUTPUT MUSIC DATA CORRESPONDING TO NUMBER
S44
OUTPUT OF MUSIC DATA COMPLETED ?
NO
YES

AUTOMATICALLY UP-DATED APPARATUS FOR GENERATING MUSIC

This is a continuation of application Ser. No. 07/656,944 filed Feb. 19, 1991, now abandoned.

BACKGROUND OF THE INVENTION

The present invention relates to a music-generating system consisting of a host unit and a plurality of terminal units for generating music.

Music-generating devices such as 'karaoke' units (units for generating musical accompaniment, i.e., the instrumental part without voice, to which people enjoy singing songs) generally include a memory medium for storing music data, e.g., magnetic tapes or optical disks. The music-generating device reads out specified music data from the memory medium according to external instructions and reproduces music corresponding to the music data.

The above conventional music-generating devices generally reproduce music corresponding to music data stored on the memory medium. Accordingly, frequent replacement of the memory medium is required for fulfilling various requirements of customers, for example, for regenerating newly released or available pieces of music. Shops or companies owning many music-generating devices such as 'karaoke' devices have to conduct troublesome replacement for each memory medium. The frequent replacement of many memory mediums requires both time and cost.

Wherefore, the object of this invention is thus to provide an improved music-generating system for efficiently supplying newly available music data to a plurality of music-generating terminal units.

Other objects and benefits of the invention will become apparent from the detailed description which follows hereinafter when taken in conjunction with the drawing figures which accompany it.

SUMMARY

The above and other related objects are realized by a music-generating system including a host unit M1 and a plurality of music-generating terminal units M2 connected to the host unit M1 as shown in FIG. 1. Each of the plurality of music-generating terminal units M2 has memory means M3 for storing a plurality of music data, reproducing means M4 for reading out specified music data from the memory means M3 according to selection signals and reproducing music corresponding to the music data, receiving means M5 for receiving music data transmitted from the host unit M1, and writing means M6 for transmitting and writing music data received by the receiving means M5 onto the memory means M3. The host unit M1 has music data supply means M9 including input means M7 for inputting music data and transmitting means M8 for transmitting music data input through the input means M7 to each of the music-generating terminal units M2.

The music-generating system of the invention thus constructed works as follows. The host unit M1 transmits music data input through the input means M7 to each of the plurality of music-generating terminal units M2 via the transmitting means M8. The music-generating terminal unit M2 then receives music data transmitted from the host unit M1 by the receiving means M5. The writing means M6 transmits and writes the music data onto the memory means M3. When selection signals are sent from an external device to the music-generating terminal unit M2, the reproducing means M4 reads out specified music data from the memory means M3 according to the selection signals and reproduces music corresponding to the music data.

DESCRIPTION OF THE DRAWINGS

The invention may be best understood by referring to the following detailed description of the preferred embodiment and the accompanying drawings, wherein like numerals denote like elements and in which:

FIG. 3 is a flowchart showing the process for receiving music data and reproducing 'karaoke' music executed in each of the 'karaoke' terminal units of FIG. 2.

DESCRIPTION OF THE PREFERRED EMBODIMENT

Figure 1:
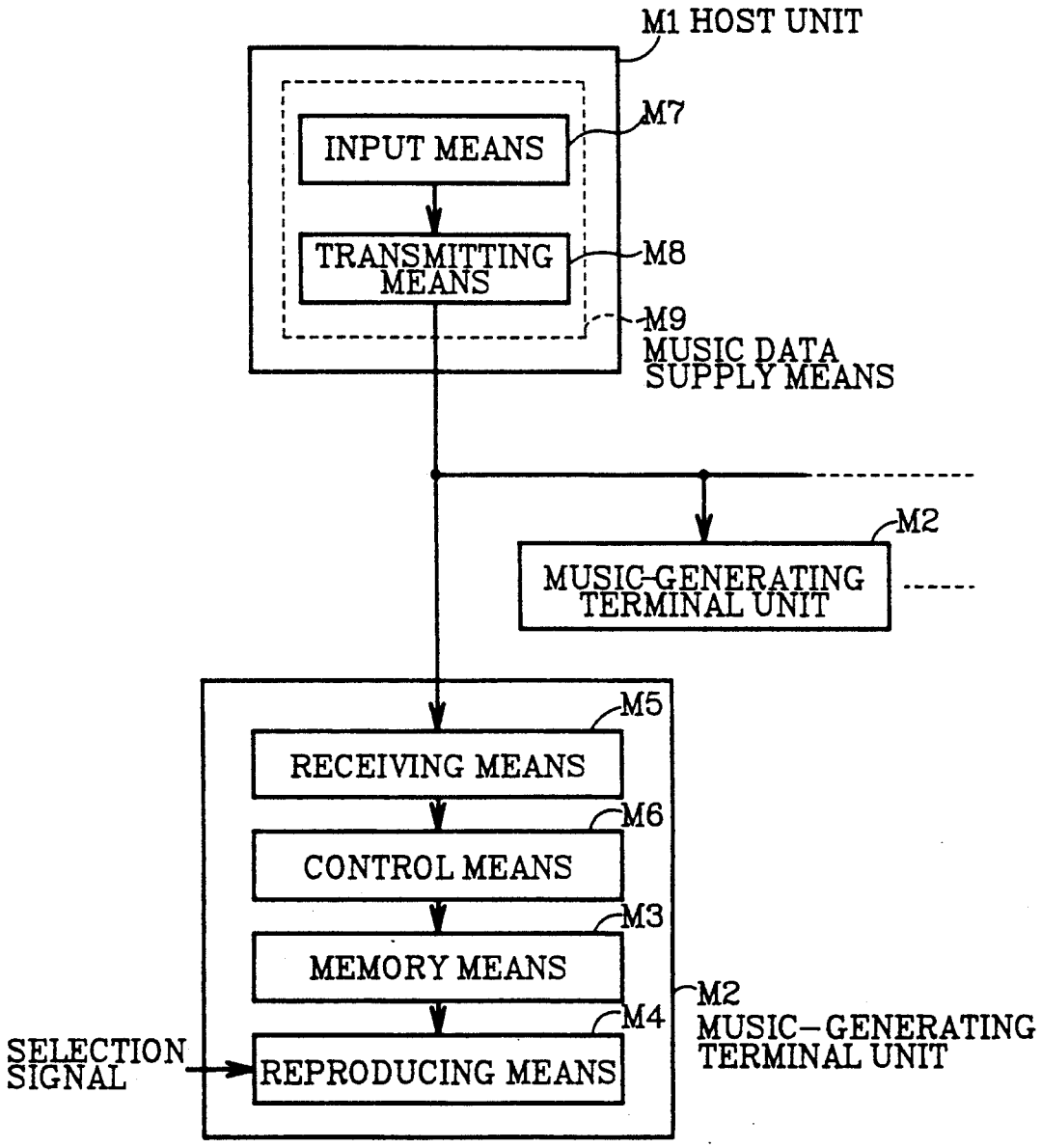
FIG. 1 is a block diagram showing basic features of the invention.

A preferred embodiment of the invention will now be explained in detail referring to the drawings. Since there may be many modifications without departing from the scope and spirit of the invention, the embodiment below is not intended to limit the invention to the disclosed embodiment; but, is intended only to illustrate the invention more clearly.

Figure 2:
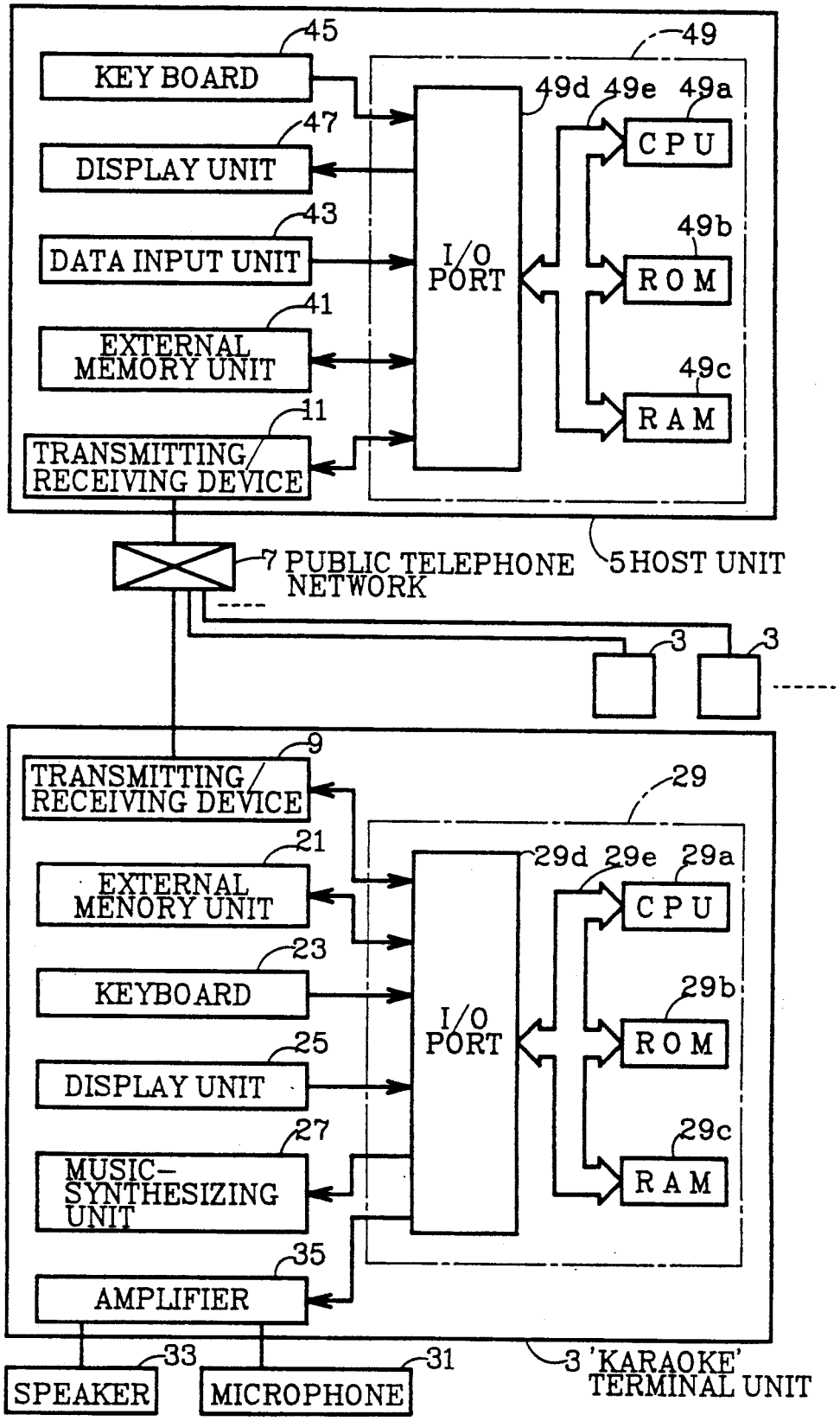
FIG. 2 is a block diagram showing the structure of a communication 'karaoke' system embodying the invention.

FIG. 2 shows the structure of a communication 'karaoke' system embodying the invention. The communication 'karaoke' system includes a plurality of 'karaoke' terminal units 3 for generating 'karaoke' music, and a host unit 5 for supplying music data such as music note data for 'karaoke' to each of the 'karaoke' terminal units 3 and controlling the 'karaoke' terminal units 3. Each of the 'karaoke' terminal units 3 has a transmitting/receiving device 9 and the host unit 5 has a transmitting-/receiving device 11, respectively. The transmitting-/receiving devices 9 and 11 are connected to a public telephone network 7, so that each of the 'karaoke' terminal units 3 and the host unit 5 communicate to each other through telephone lines.

In addition to the transmitting/receiving device 9, each 'karaoke' terminal unit 3 includes an external memory unit 21 such as a hard disk for storing various music data for 'karaoke', a keyboard 23 for inputting selection signals and various information including communication commands for the host unit 5, and a display unit 25 for displaying operational procedure of the 'karaoke' terminal unit 3 and some other messages. The 'karaoke' terminal units 3 further has a music-synthesizing unit 27 including a synthesizer for converting digital music data into analog music signals, and a control unit 29 connected to the other devices and units 9, 21, 23, 25, and 27 for controlling data transfer between the 'karaoke' terminal unit 3 and the host unit 5 and reproducing music corresponding to music data.

The 'karaoke' terminal unit 3 also includes an amplifier 35 for mixing music signals sent from the music-synthesizing unit 27 with a voice input through a microphone 31, amplifying the mixture, and outputting it through a speaker 33. The control unit 29 is a microcomputer including a central processing unit (hereinafter referred to as CPU) 29*a*, a read only memory (hereinafter referred to as ROM) 29*b*, a random access memory (hereinafter referred to as RAM) 29*c*, an input-/output port (hereinafter referred to as I/O port) 29*d*, and bus lines 29*e* for connecting them to one another.

In addition to the transmitting/receiving device 11, the host unit 5 includes an external memory unit 41 for storing various data including newly available music data which will be transmitted to each of the 'karaoke' terminal units 3, a data input unit 43 for inputting various data, and a keyboard 45 for inputting commands including communication commands for the 'karaoke' terminal units 3. The host unit 5 further has a display unit 47 for displaying input data and messages, and a control unit 49 for conducting data management and controlling data transfer between the host unit 5 and each of the 'karaoke' terminal units 3. The control unit 49 is a microcomputer including a CPU 49*a*, a ROM 49*b*, a RAM 49*c*, an I/O port 49*d*, and bus lines 49*e* for connecting them to one another.

The communication 'karaoke' system of the embodiment includes the host unit 5 and the plurality of 'karaoke' terminal units 3 connected to each other through telephone lines, thus efficiently and effectively exchanging various data to each other.

Figure 4:
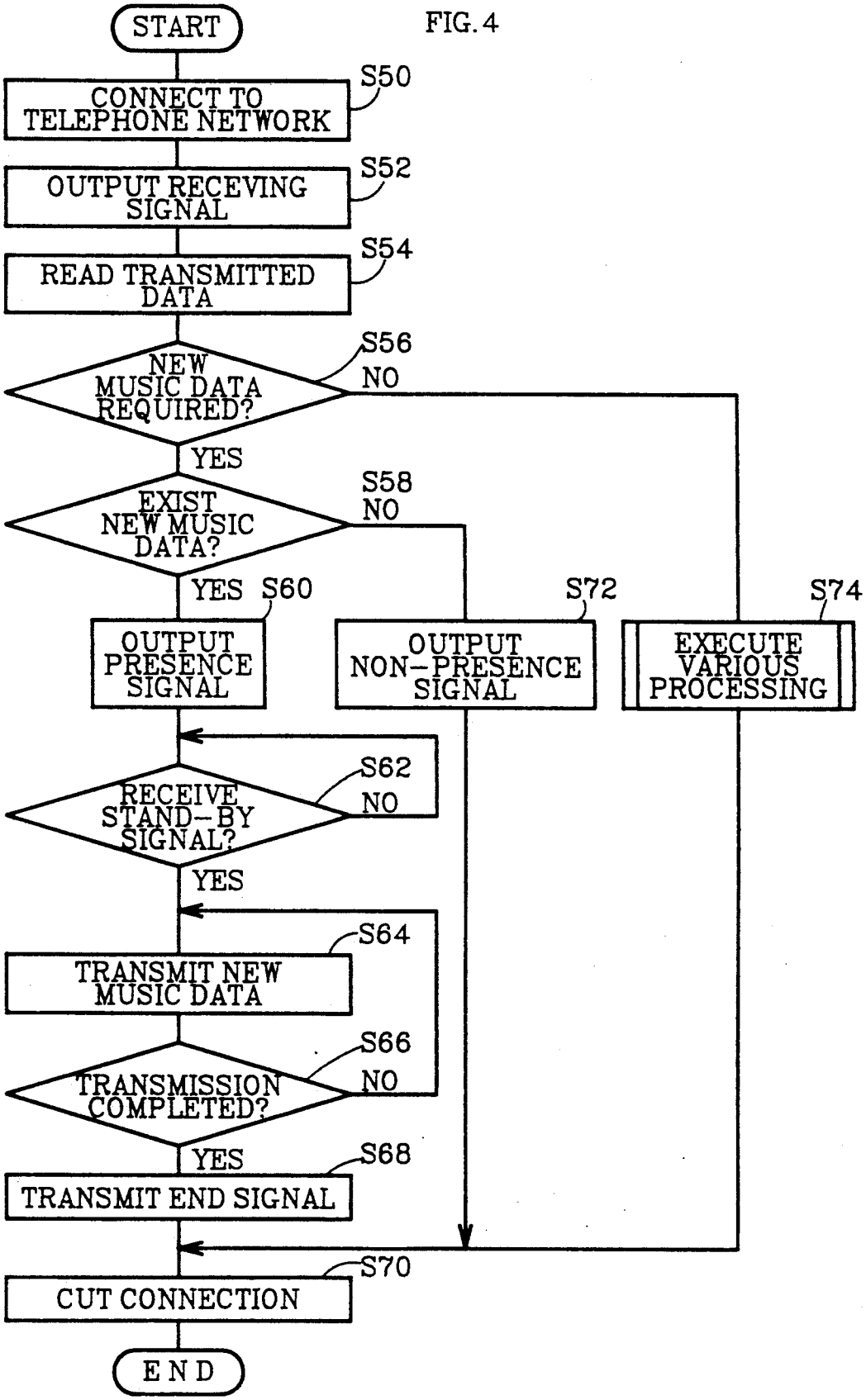
FIG. 4 is a flowchart showing the process for transmitting music data executed in the host unit of FIG. 2.

The process for receiving music data and reproducing 'karaoke' music executed in each of the 'karaoke' terminal units 3 will now be explained based on the flowchart of FIG. 3, and the process for transmitting music data corresponding to the control process of the 'karaoke' terminal units 3 executed in the host unit 5 will be explained based on the flowchart of FIG. 4.

When the 'karaoke' terminal unit 3 is turned on, the control unit 29 starts the process shown in FIG. 3. The control unit 29 connects the transmitting/receiving device 9 to a telephone network at step S10 and calls the host unit 5 at step S12. At step S14 it is checked if the host unit 5 is occupied, that is, if it is communicating with another 'karaoke' terminal unit 3. When the answer is YES at step S14, the program proceeds to step S16 at which the connection to the telephone network is cut, and returns to step S10.

On the other hand, when the answer is NO at step S14, that is, when the host unit 5 is not occupied, the program proceeds to step S18 at which it is determined if the transmitting/receiving device 9 detects a receiving signal, which is sent from the transmitting/receiving device 11 of the host unit 5 when the device 11 is connected to the telephone network. When the transmitting/receiving device 9 detects the receiving signal, the program proceeds to step S20 at which an identification number representing the specific 'karaoke' terminal unit 3 and a signal for requiring newly available music data are transmitted to the host unit 5.

Receiving the requiring signal, the host unit 5 checks if there is newly available music data for the specific 'karaoke' terminal unit 3, and sends back either a PRESENCE signal or a NON-PRESENCE signal to the transmitting/receiving device 9 (details of this process will be described later according to the flowchart of FIG. 4). At step S22, it is determined if the transmitting-/receiving device 9 receives any signal. When the answer is YES at step S22, the program proceeds to step S24 at which it is checked if the signal received is a PRESENCE signal or a NON-PRESENCE signal. When the signal is a PRESENCE signal, program proceeds to step S26.

The control units 29 chooses a storage area for storing newly available music data in the external memory unit 21, and sends a stand-by signal to the host unit 5 at step S26.

Receiving the stand-by signal, the host unit 5 successively transmits music data and auxiliary data including identification numbers each representing a specific music piece to the 'karaoke' terminal unit 3 (details of this process will be described later according to the flowchart of FIG. 4). The program then proceeds to step S28 at which music data transmitted are read and then sent to the external memory unit 21. At step S30, it is determined if the transmitting/receiving device 9 detects an end signal, which is sent from the host unit 5 when transmission of all newly available music data is completed. When the transmitting/receiving device 9 does not detect the end signal, the program returns to step S28.

When the transmitting/receiving device 9 detects the end signal at step S30 or when the answer is NO at step S24, the program proceeds to step S32 at which the connection to the telephone network is cut. At step S34, a message asking for selection of music pieces is displayed on the display unit 25. At step S36, it is determined if a selection signal is input through the keyboard 23. Selection of a music piece may be conducted by inputting an identification number representing a specific music piece.

When the selection signal is input, the program proceeds to step S38 at which the identification number of the music piece is displayed on the display unit 25. Then at step S40, it is checked if a start command is input through the keyboard 23. When the answer is YES at step S40, the program proceeds to step S42 at which music data corresponding to the identification number are read out from the external memory unit 21 and transmitted to the music-synthesizing unit 27, so that music is generated corresponding to the music data. At step S44, it is determined if reproduction of the music data is completed. When it is not completed, the program returns to step S42, and when it is completed, the program returns to step S34. When not the start command but a cancel command is input through the keyboard 23 while the identification number of the specific music piece is displayed at step S38, an interruption routine (not shown) is activated to stop the display on the display unit 25 and the program returns to step S34.

The data transmitting process executed in the host unit 5 will now be explained based on the flowchart of FIG. 4. This routine is executed when the host unit 5 is called through the telephone network. The host unit 5 connected to the telephone network at step S50 outputs a receiving signal at step S52, and reads data transmitted from the 'karaoke' terminal unit at step S54. At step S56, it is determined if the data transmitted is a signal for requiring newly available music data.

When thenswer is NO at step S56, the program proceeds to step S74 at which other transmitting or receiving processes are executed according to data transmitted. The host unit 5 receives various data, including the reproduction frequency of each music data, working time of the 'karaoke' terminal unit, and amount of money collected, sent from the 'karaoke' terminal unit 3 at a regular interval. The host unit 5 also transmits data required by the 'karaoke' terminal unit 3. After executing one of these processes, the program proceeds to step S70 at which the connection to the telephone network is cut, and then exits from the routine.

On the other hand, when the answer is YES at step S56, the program proceeds to step S58 at which it is checked if there is newly available music data for the 'karaoke' terminal unit specified by the identification number sent with the requiring signal.

Every time music data are newly transmitted to a specified 'karaoke' terminal unit, the identification number of the unit is registered in the external memory unit 41 of the host computer 5 as explained later. Thus, the host computer 5 checks if the identification number exists in the external memory unit 41 at step S58. Music data are previously transmitted to and stored in the external memory unit 41 through the data input unit 43 and the keyboard 45.

When the answer is YES at step S58, the program proceeds to step S60 at which a PRESENCE signal is output through the telephone line. When the answer is NO at step S58, on the other hand, the program proceeds to step S72 at which a NON-PRESENCE signal is output through the telephone line. The 'karaoke' terminal unit 3 judges existence of newly available music data according to the signal. After executing step S72, the program proceeds to step S70 at which the communication to the telephone network is cut, and exits from the routine.

After the output of a PRESENCE signal at step S60, the program proceeds to step S62 at which it is determined if the transmitting/receiving device 11 receives a stand-by signal transmitted from the 'karaoke' terminal unit 3. When the transmitting/receiving device 11 receives a stand-by signal at step S62, the program proceeds to step S64 at which the host unit 5 successively reads out newly available music data from the external memory unit 41 and transmits them to the 'karaoke' terminal unit 3. At step S66, it is determined if transmission of all available music data is completed. When the answer is NO at step S66, the program returns to step S64, and when the answer is YES, the program proceeds to step S68. At step S68, an identification number representing the specific 'karaoke' terminal unit 3 is registered in the external memory unit 41 and an end signal is transmitted to the 'karaoke' terminal unit 3. The program then proceeds to step S70 at which the connection to the telephone network is cut, and exits from the routine.

As described above, in the communication 'karaoke' system of the embodiment, all available music data are input in the external memory unit 41 of the host unit 5, and are transmitted to each of the plurality of 'karaoke' terminal units 3 based on requirements. Thus, the communication 'karaoke' system does not require any troublesome replacement of a memory medium, which is required for each 'karaoke' unit in the conventional system. Namely, this system is cost-saving and labor-saving. Since registration of newly available music data is executed when the 'karaoke' terminal unit is turned on, the system of the embodiment can efficiently fulfill various requirements of customers.

In the music-generating system of the invention, all available music data are first input in the host unit and then transmitted to each of the plurality of music-generating terminal units. Thus, the music-generating system fulfills various requirements of customers efficiently and effectively without doing any troublesome replacement of memory mediums.

Wherefore, having thus described the present invention, what is claimed is:

1. In a music-generating system comprising a host unit and a plurality of music-generating terminal units connectable to the host unit, the improvement for reducing the effort of providing newly available music at the plurality of music-generating terminal units comprising:

a) each of the plurality of music generating terminal units comprising, a1) musical accompaniment selection means for generating selection signals indicative of a desired musical accompaniment selection, a2) memory means for storing a plurality of music data corresponding to a plurality of musical accompaniment selections, a3) reproducing means for reading out specified previously stored music data corresponding to the desired musical accompaniment selection from said memory means according to the selection signals and reproducing music corresponding to said music data;

a4) receiving means for receiving newly available music data transmitted from the host unit, said receiving means comprising means for interfacing with a telephonic network, a5) writing means for writing music data received by said receiving means into said memory means, and a6) terminal identification means for generating terminal identification data corresponding to each of the plurality of music-generating terminal units; and, b) the host unit having music data supply means comprising, b1) input means for inputting the newly available music data, b2) transmitting means for transmitting the newly available music data input through said input means to each of the plurality of music-generating terminal units, said transmitting means comprising means for interfacing with said telephonic network, and b3) checking means for checking if there is any newly available music data to be transmitted to the music-generating terminal unit corresponding to the terminal identification data generated by said terminal identification means upon connection with the music-generating terminal unit through said telephonic network.

2. The improvement to a music-generating system of claim 1 wherein:

said receiving means further comprises means for establishing a connection with said transmitting means via said telephonic network.

3. The improvement to a music-generating system of claim 1 wherein:

said receiving means and said transmitting means further comprise means for establishing a working connection between the host unit and only one the plurality of music-generating terminal units before transmitting the newly available music data input through said input means to said one of the plurality of music-generating terminal units.

4. A music-generating system capable of efficiently supplying newly available music data to a plurality of music-generating terminal units comprising:

a) a host unit comprising, a1) input circuit means for inputting newly available music data, a2) transmit circuit means for transmitting said newly available music data input through said input circuit means to each of a plurality of music-generating terminal units, said transmit circuit means including first means for interfacing with a telephonic network, and a3) check circuit means for checking if there is said newly available music data to be transmitted to each of a plurality of said music-generating terminal units; and, b) a plurality of said music-generating terminal units each comprising, b1) musical accompaniment selection means for generating selection signals indicative of a desired musical accompaniment selection;

b2) music data memory, b3) receive circuit means for receiving said newly available music data transmitted from said host unit, said receive circuit means including second means for interfacing with said telephonic network and means for calling said transmit circuit means with said telephonic network, b4) write circuit means for writing the received newly available music data into said music data memory, b5) reproduce circuit means responsive to the selection signals from said musical accompaniment selection means to the music-generating terminal unit for reading out specified music data among previously stored music data and said written newly available music data in said music data memory corresponding to said selection signals and for reproducing music corresponding to said specified music data, and b6) terminal identification means for generating terminal identification data corresponding to each of a plurality of said music-generating terminal units, said terminal identification data being transmitted to said host unit through said telephonic network so that said check circuit means checks if there is said newly available music data to be transmitted to the music-generating terminal unit corresponding to said generated terminal identification data, whereby transmission of music data by said transmit circuit means is performed when said check circuit means checks that there is said newly available music data.

5. The music-generating system of claim 4 wherein:

said receive circuit means and said transmit circuit means further comprises means for establishing a working connection between said host unit and only one of said plurality of music-generating terminal units before transmitting music data input to said one of said plurality of music-generating terminal units.

6. The music-generating system of claim 5 wherein said means for establishing a working connection includes logic means for breaking a connection to said host unit over said telephonic network if said host unit is connected to another of said plurality of music-generating terminal units.

7. The music-generating system of claim 5 wherein said means for establishing a working connection includes logic means for establishing a wait condition until a receiving signal is received from said host unit over said telephonic network.

8. The music-generating system of claim 5, wherein said means for establishing a working connection includes logic means for terminating a connection to said host unit over said telephonic network upon receipt of a non-presence signal from said host unit that the host unit does not have any newly available music data to transmit to said plurality of music-generating terminal units.

9. The music-generating system of claim 8 wherein said means for establishing a working connection includes logic means for maintaining a connection to said host unit when a presence signal indicating that the host unit has newly available music data to transmit to said plurality of music-generating terminal units is sent by said host unit and transmission of the newly available music data has begun, until said host unit indicates that it has no more newly received music data to transmit to said music-generating terminal unit.

10. In a music-generating system comprising a host unit and a plurality of music-generating terminal units connectable to the host unit, the improvement for reducing the effort of providing newly available music at the plurality of music-generating terminal units, comprising:

(a) musical accompaniment selection means for generating selection signals indicative of a desired musical accompaniment selection;

(b) memory means in each of the plurality of music-generating terminal units for storing a plurality of music data representative of the plurality of musical accompaniment selections, (c) reproducing means in each of the plurality of music-generating terminal units for reading out specified previously stored music data corresponding to the desired musical accompaniment selection from said memory means according to the selection signals from said musical accompaniment selection means and reproducing music corresponding to said music data;

(d) receiving means in each of the plurality of music-generating terminal units for receiving the newly available music data transmitted from the host unit;

(e) writing means in each of the plurality of music-generating terminal units for storing the newly available music data received by said receiving means into said memory means;

(f) terminal identification means in each of the plurality of music-generating terminal units for generating a unique terminal identification data corresponding to that particular music-generating terminal unit;

(g) input means in the host unit for inputting the newly available music data;

(h) transmitting means in the host unit for transmitting the newly available music data input through said input means to each of the plurality of music-generating terminal units;

(i) checking means in the host unit for checking if there is any newly available music data input through said input means to be transmitted to a specified one of the plurality of music-generating terminal units according to said unique terminal identification data generated by said terminal identification means, said checking means operating said transmitting means to transmit the newly available music data to the specified music-generating terminal unit upon connection.

11. In a music-generating system comprising a host unit and a plurality of music-generating terminal units connectable to the host unit, the improvement for reducing the effort of providing new music at the plurality of music-generating terminal units, comprising:

means for connecting the host unit to at least one of the plurality of terminal units;

the host unit comprising means for sending a terminal ready inquiry signal to the at least one of the plurality of terminal units when the host unit is connected to the at least one of the plurality of terminal units;

the at least one of the plurality of terminal units comprising means for receiving the terminal ready inquiry signal and means for sending a request for newly available music data signal to the host unit when the terminal ready inquiry signal is received and the at least one of the plurality of terminal units is ready to receive newly available music data;

the host unit further comprising means for receiving the request for newly available music data signal and selective means for sending any newly available music data corresponding to at least one musical accompaniment selection to the at least one of the plurality of terminal units after the request for newly available music data signal is received upon determining there is newly available music to be transmitted to the at least one of a plurality of terminal units;

the at least one of the plurality of terminal units further comprising means for receiving the newly available music data and means for sending to the host unit an end signal after all of the newly available music data is received;

the host unit further comprising means for receiving the end signal and means for terminating connection with the at least one of the plurality of terminal units when the end signal is received;

the at least one of the plurality of terminal units further comprising musical accompaniment selection means for selecting music data from the newly available music data corresponding to a desired one of the at least one musical accompaniment selection; and the at least one of the plurality of terminal units further comprising means for reproducing music from the selected music data.

12. The improvement to a music generating system of claim 11, wherein the at least one of the plurality of terminal units further comprises means to automatically initiate said means for connecting the host unit to the at least one of the plurality of terminal units when power to the at least one of the plurality of terminal units is turned on.

13. The improvement to a music generating system of claim 11, wherein said selective means for sending the newly available music data sends the newly available music data when the newly available music data is present in the host unit.

14. The improvement to a music generating system of claim 11, wherein:

said means for sending the request newly available music data signal comprises means for sending terminal identification data;

said means for receiving the request newly available music data signal comprises means for receiving the terminal identification data; and said selective means for sending the newly available music data includes determining means responsive to the terminal identification data for determining when any newly available music data is present in the host unit.

15. The improvement to a music generating system of claim 14, wherein:

the host unit further comprises storing means for memorizing the terminal identification number after the newly available music data is sent; and said determining means determines that newly available music data is present when new music data is received by the host unit after said storing means memorizes the terminal identification number.

16. The improvement to a music generating system of claim 11, wherein the at least one of the plurality of terminal units further comprises independent operating mode means for enabling operation of the terminal unit in a mode for reproducing music data when said means for terminating connection terminates connection with the host unit.

17. The improvement to a music generating system of claim 16, wherein the at least one of the plurality of terminal units further comprises means for playing music from music data in the terminal unit and independent operating mode means comprises means for enabling operation of said means for playing music.

18. The music-generating system of claim 10, wherein:

said checking means comprises host identification means for receiving and storing said unique terminal identification data transmitted from said terminal identification means.

19. The music-generating system of claim 18, wherein:

said checking means further comprises means for generating a presence signal when there is newly available music data input through said input means to be transmitted to specified music-generating unique terminal unit corresponding to said terminal identification data stored in said host identification means.

20. The music-generating system of claim 19, wherein:

said receiving means operates in response to said presence signal transmitted from said checking means.

21. The improvement to a music-generating system of claim 1, wherein:

said terminal identification means sends said terminal identification data to said checking means through said telephonic network when each of the plurality of music-generating terminal units is turned on.

22. The improvement to a music-generating system of claim 1, wherein:

each of the plurality of music-generating terminal units further comprises means for transmitting to said host unit a request newly available music data signal for requiring newly available music data input by said input means, and means for generating reproduction frequency data representing how frequently each music data stored in said memory means is reproduced by said reproducing means; and said host unit further comprises means for determining if a signal transmitted from each of the plurality of music-generating terminal units is said request newly available music data signal, and means for receiving said reproduction frequency data when it is determined that a transmitted signal is not said request newly available music data signal and for operating said checking means when it is determined that a transmitted signal is said request newly available music data signal.

* * * * *